US007524173B2

(12) United States Patent
Cummins

(10) Patent No.: US 7,524,173 B2
(45) Date of Patent: Apr. 28, 2009

(54) METHOD FOR ASSEMBLING A MODULAR FLUID END FOR DUPLEX PUMPS

(75) Inventor: Milburn Eugene Cummins, Houston, TX (US)

(73) Assignee: EC Tool and Supply Company, Abilene, TX (US)

( * ) Notice: Subject to any disclaimer, the term of this patent is extended or adjusted under 35 U.S.C. 154(b) by 0 days.

(21) Appl. No.: 11/933,927

(22) Filed: Nov. 1, 2007

(65) Prior Publication Data

US 2008/0078583 A1 Apr. 3, 2008

Related U.S. Application Data

(62) Division of application No. 11/536,260, filed on Sep. 28, 2006, now Pat. No. 7,354,256.

(51) Int. Cl.
*F04B 35/00* (2006.01)

(52) U.S. Cl. ..... 417/515; 417/338

(58) Field of Classification Search ..... 417/515, 417/535, 536, 539, 338, 339, 342, 346
See application file for complete search history.

(56) References Cited

U.S. PATENT DOCUMENTS 2,887,955 A 5/1959 Owen
4,242,057 A 12/1980 Bender
4,500,267 A 2/1985 Birdwell
4,735,129 A * 4/1988 Sjoberg ..... 92/251
4,899,832 A 2/1990 Bierscheid, Jr.
5,061,159 A 10/1991 Pryor
5,616,009 A 4/1997 Birdwell
6,454,542 B1 9/2002 Back
6,588,318 B2 7/2003 Aday et al.

* cited by examiner

*Primary Examiner*—Michael Cuff
*Assistant Examiner*—Vikansha S Dwivedi
(74) *Attorney, Agent, or Firm*—Pramudji Wendt & Tran, LLP; Ari Pramudji

(57) ABSTRACT

A fluid end for a duplex mud pump. In one implementation, the fluid end includes two liner blocks, each having a central passage. The fluid end further includes two fluid inlets disposed on a side portion and two fluid outlets disposed on a top portion and a suction manifold displaced from the two liner blocks. The suction manifold comprises four flanges. The fluid end further includes four suction valve blocks, each having a bottom portion removably coupled to one of the four flanges and a side portion removably coupled to the side portion of the liner block, and four discharge valve blocks, each having a bottom portion removably coupled to the top portion of the liner block.

20 Claims, 11 Drawing Sheets

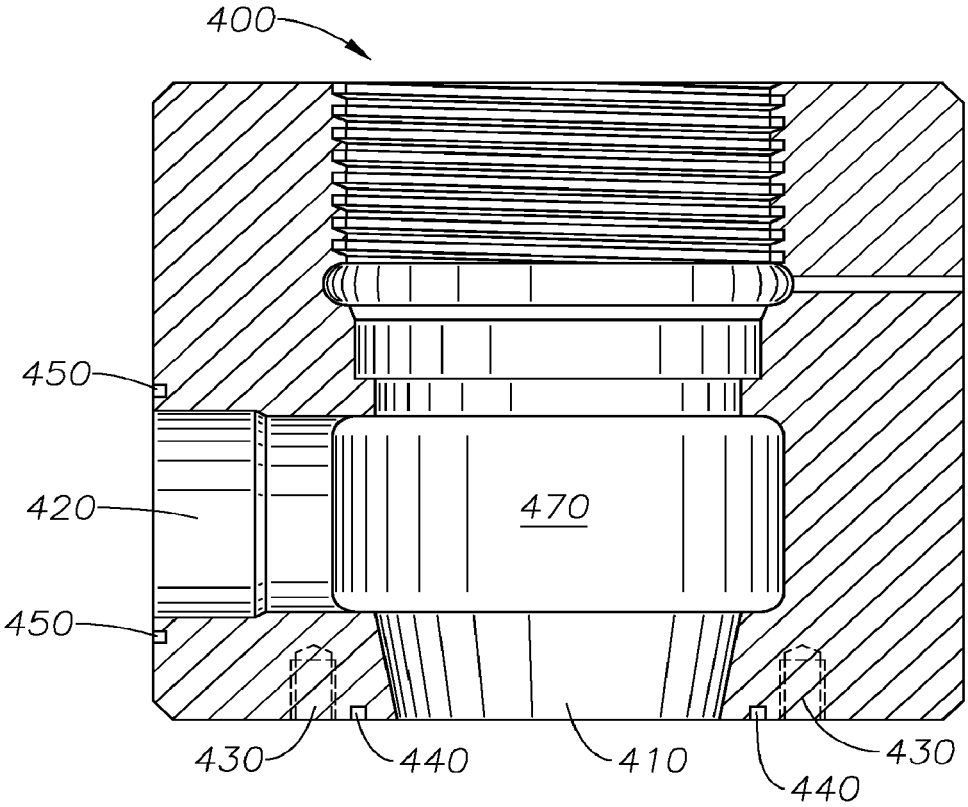
Fig. 4A
Fig. 4B
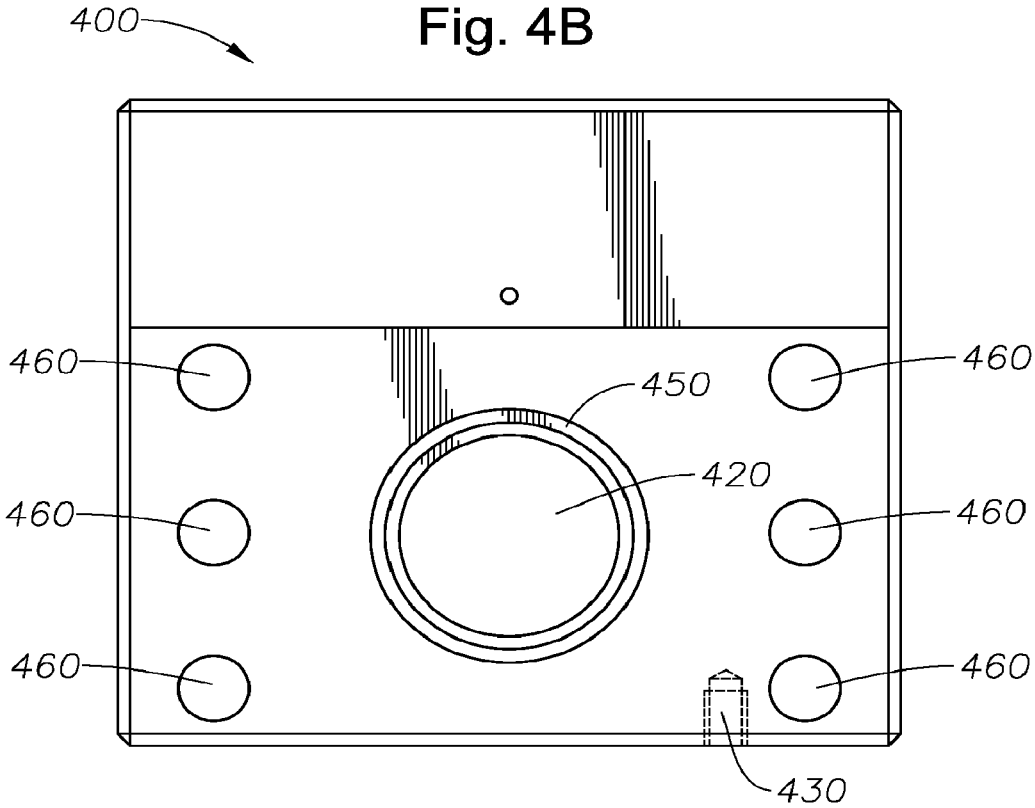

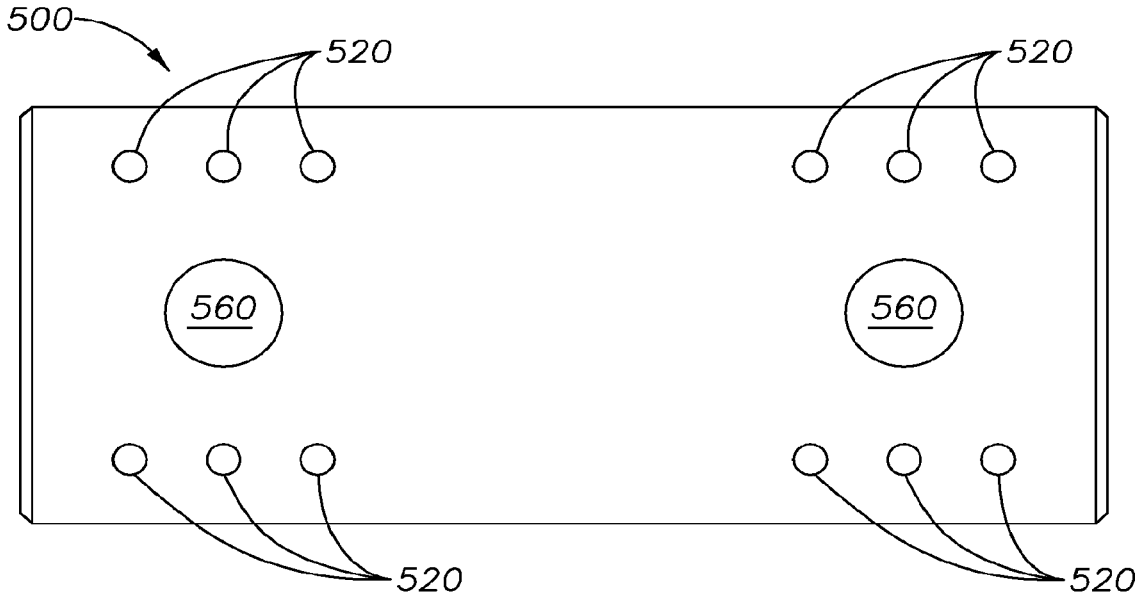
Fig. 5D
Fig. 6A
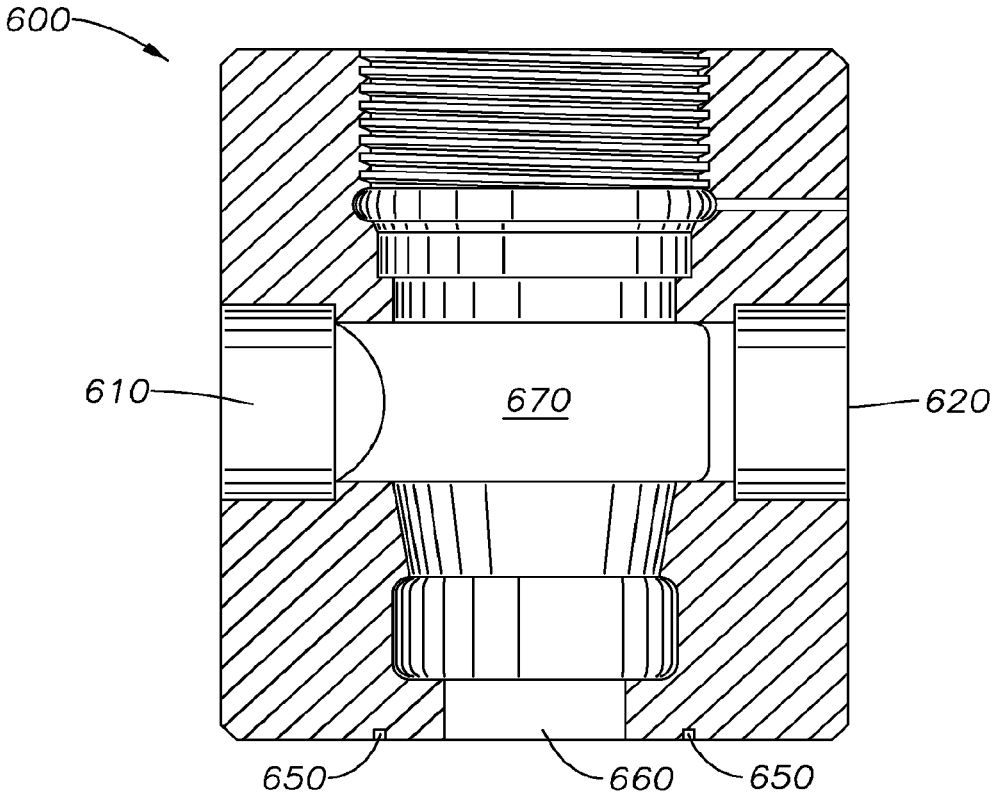

METHOD FOR ASSEMBLING A MODULAR FLUID END FOR DUPLEX PUMPS

CROSS-REFERENCE TO RELATED APPLICATIONS

This application is a divisional of co-pending U.S. patent application Ser. No. 11/536,260, filed Sep. 28, 2006 now U.S. Pat. No. 7,354,256. The aforementioned related patent application is herein incorporated by reference.

BACKGROUND

1. Field of the Invention

Implementations of various technologies described herein generally relate to mud pumps, particularly duplex mud pumps.

2. Description of the Related Art

The following descriptions and examples are not admitted to be prior art by virtue of their inclusion within this section.

In extracting hydrocarbons, such as oil and gas, from the earth, it is common to drill a wellhole into the formation containing the hydrocarbons. Typically, a drill bit is attached to a drill string, including joined sections of drill pipe, which may be suspended from a drilling rig. As the drill bit rotates, the hole deepens and the string is lengthened by attaching additional sections of drill pipe. During such drilling operations, drilling fluid, or "mud", may be pumped down through the drill pipe and into the hole through the drill bit. The circulating drilling fluid serves a multitude of purposes, including cooling and lubricating the drill bit, removing drill cuttings and transporting them to the surface, preventing ingress into the wellhole of unwanted material such as oil, water, and gas, and equalizing downhole pressure by providing downhole weight.

Reciprocating mud pumps are commonly used for pumping the drilling fluid. FIG. 1 illustrates a front view of a typical duplex mud pump 100. The pump 100 consists of a fluid end 160 and a power end 170. The fluid end 160 imports, pressurizes and exports fluid. The power end 170 includes a power source, typically a diesel engine, and a crank shaft 110 which transmits power and motion to a connecting rod 120. The connecting rod 120 articulates the motion of the crank shaft 110 to a crosshead 130. The crosshead 130 creates a linear reciprocating motion derived from the crank shaft 110 rotary motion through the connecting rod 120. The reciprocating motion of the crosshead 130 is applied to a piston 150 by a shaft 140. In the fluid end 160, the reciprocating piston 150 discharges pressurized fluid from a cylindrical liner block in the fluid end 160.

Mud pumps can be single acting, in which fluid is discharged on forward piston strokes, or double acting, in which each piston stroke, forward and backward, discharges fluid. A duplex mud pump has two double-acting reciprocating pistons disposed in two corresponding cylinders, each forcing fluid in one or more discharge lines.

Mud pumps typically operate at very high pressures in order to pump the drilling fluid through several thousand feet of drill pipe and still deliver the fluid at a relatively high velocity. In addition, the fluid that may be pumped may be corrosive and/or abrasive. The high pumping pressures and corrosive and abrasive nature of the fluid often cause washouts in the fluid end. Washouts are holes in pressure-containing components caused by erosion. Washouts in the pistons, cylinders, valves and other components of the fluid end may be the most common cause of mud pump fluid end failure. Duplex mud pump fluid ends are typically made from one piece of welded metal. When a washout occurs in a fluid end, the fluid end must be welded and repaired either by using a welder and portable boring system in the field or by moving the fluid end to a machine shop. Both of these methods are expensive and time consuming. It is, therefore, desirable to have a high-pressure, reciprocating, mud pump that can be easily and quickly repaired in the field and inexpensive to manufacture.

SUMMARY

Described herein are implementations of various technologies for a fluid end for a duplex mud pump. In one implementation, the fluid end includes two liner blocks, each having a central passage. The fluid end further includes two fluid inlets disposed on a side portion and two fluid outlets disposed on a top portion and a suction manifold displaced from the two liner blocks. The suction manifold comprises four flanges. The fluid end further includes four suction valve blocks, each having a bottom portion removably coupled to one of the four flanges and a side portion removably coupled to the side portion of the liner block, and four discharge valve blocks, each having a bottom portion removably coupled to the top portion of the liner block.

Described herein are implementations of various technologies for a liner block for a fluid end. In one implementation, the liner block includes a body having a central passage laterally disposed therethrough, two fluid inlets disposed on a side portion of the body, two fluid outlets disposed on a top portion of the body, a first set of holes disposed on each side of the fluid inlets for receiving a first set of fasteners and a second set of holes disposed on each side of the fluid outlets for receiving a second set of fasteners.

Described herein are implementations of various technologies for a suction valve block for a fluid end. In one implementation, the suction valve block includes a fluid inlet disposed on a bottom portion for receiving fluid from a suction manifold, a fluid outlet disposed on a side portion for sending fluid to a liner block, a central passage disposed between the fluid inlet and the fluid outlet and a first set of holes disposed around the fluid inlet for receiving a first set of fasteners.

Described herein are implementations of various technologies for a discharge valve block for a fluid end. In one implementation, the discharge valve block includes a fluid inlet disposed on a bottom portion for receiving fluid from a liner block, a fluid outlet disposed on a side portion for sending fluid to a discharge connector and a set of holes linearly disposed through the discharge valve block around the fluid inlet for receiving a set of fasteners.

Described herein are implementations of various technologies for a discharge connector for a fluid end. In one implementation, the discharge connector includes a first fluid inlet having a first o-ring disposed proximate thereto, a second fluid inlet having a second o-ring disposed proximate thereto and a fluid outlet disposed between the first fluid inlet and the second fluid inlet at a top portion of the discharge connector.

Described herein are implementations of various technologies for a method for assembling a fluid end for a duplex pump. In one implementation, the method includes coupling a first set of suction valve blocks to a side portion of a first liner block, coupling a second set of suction valve blocks to a side portion of a second liner block, coupling the first and second sets of suction valve blocks to a suction manifold, coupling a first discharge valve block to a first end of the first liner block, coupling a second discharge valve block to the first end of the second liner block, coupling a first discharge connector to the first discharge valve block, coupling a second discharge connector to the second discharge valve block, coupling a third discharge valve block to a second end of the first liner block, coupling a fourth discharge valve block to the second end of the second liner block, coupling the first discharge connector to the third discharge valve block and coupling the second discharge connector to the fourth discharge valve block.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

Implementations of various technologies will hereafter be described with reference to the accompanying drawings. It should be understood, however, that the accompanying drawings illustrate only the various implementations described herein and are not meant to limit the scope of various technologies described herein.

FIGS. 4A-B illustrate a suction valve block in accordance with implementations of various technologies described herein.

FIGS. 5A-D illustrate a liner block in accordance with implementations of various technologies described herein.

FIGS. 6A-C illustrate a discharge valve block in accordance with implementations of various technologies described herein.

DETAILED DESCRIPTION

Figure 1:
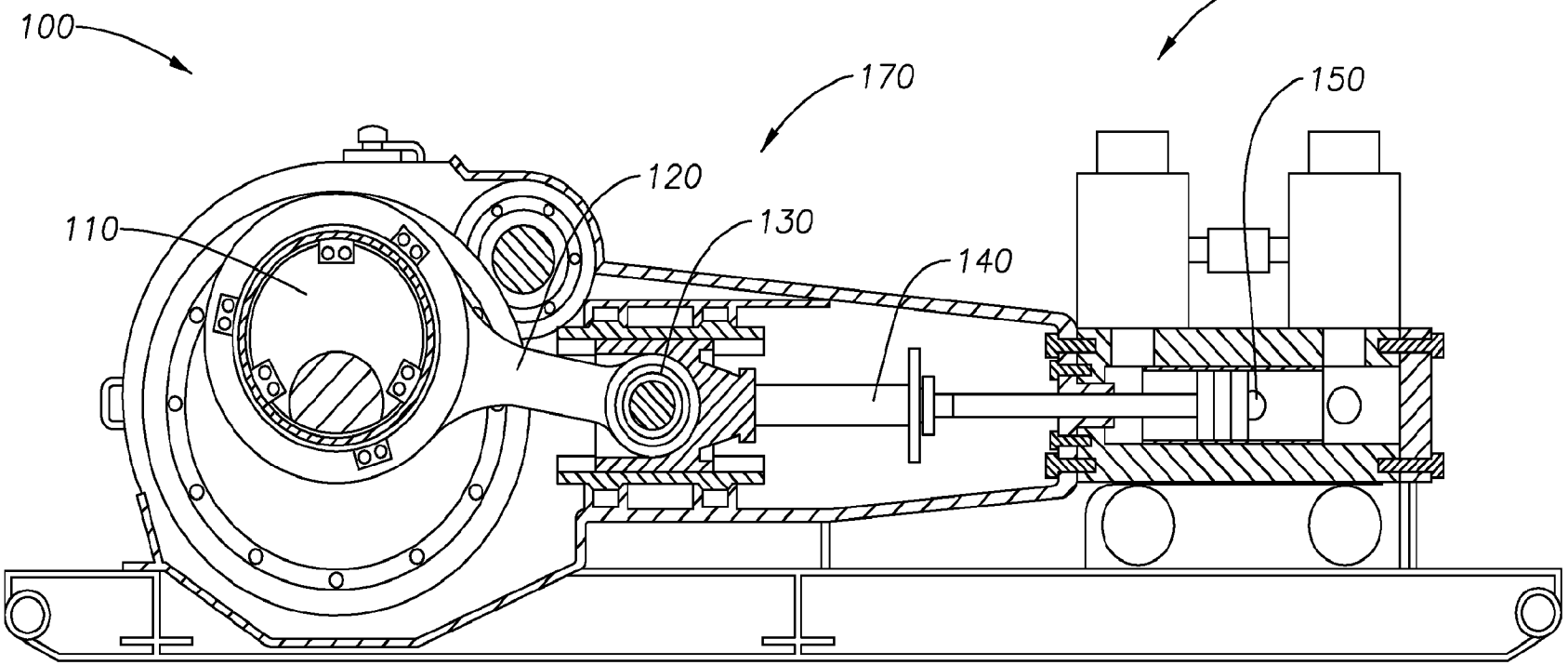
Fig. 1 (Prior Art)
FIG. 1 illustrates a side view of a typical duplex mud pump.
Figure 2A:
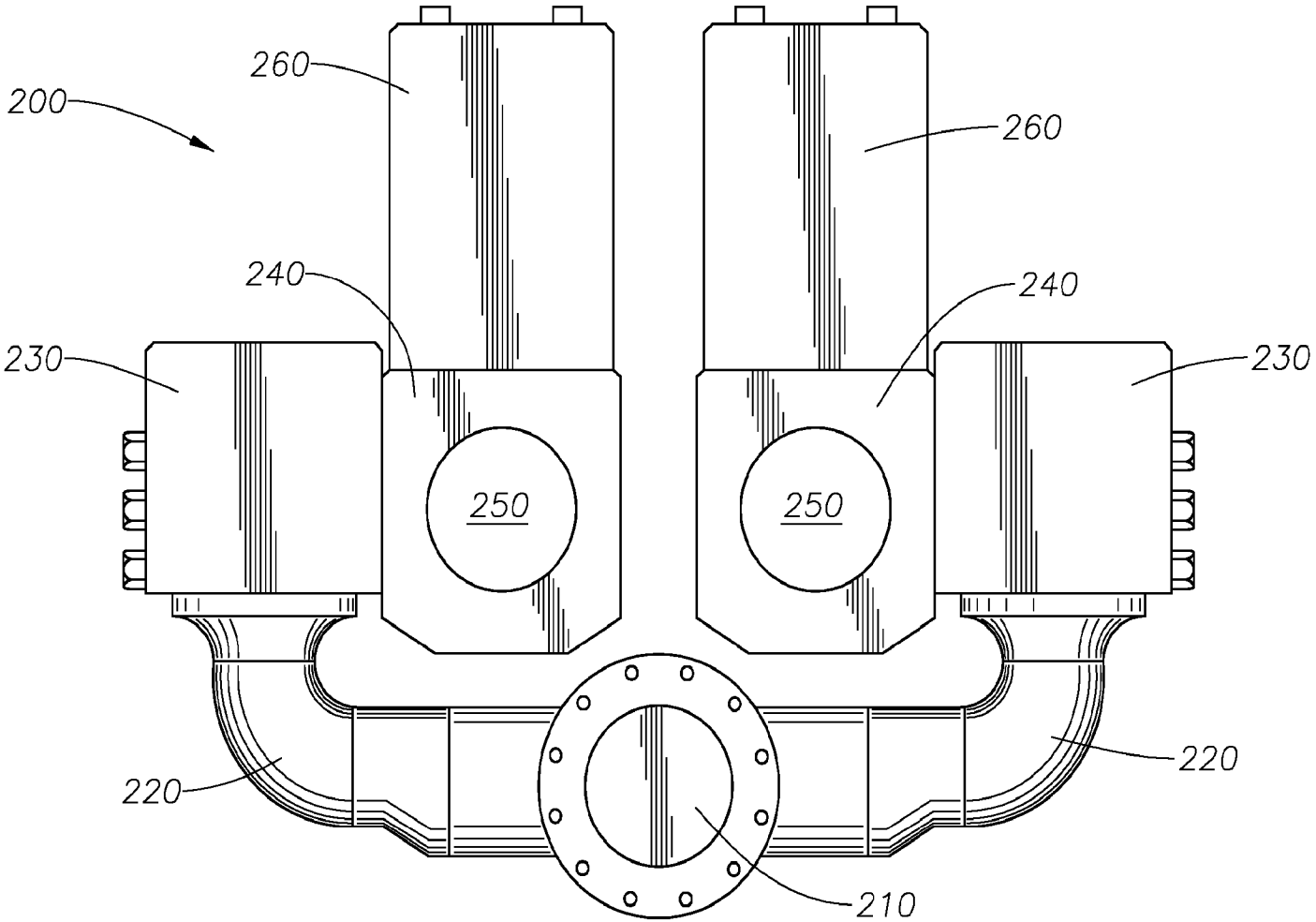
FIGS. 2A-B illustrate a fluid end of a duplex mud pump in accordance with implementations of various technologies described herein.
Figure 2B:
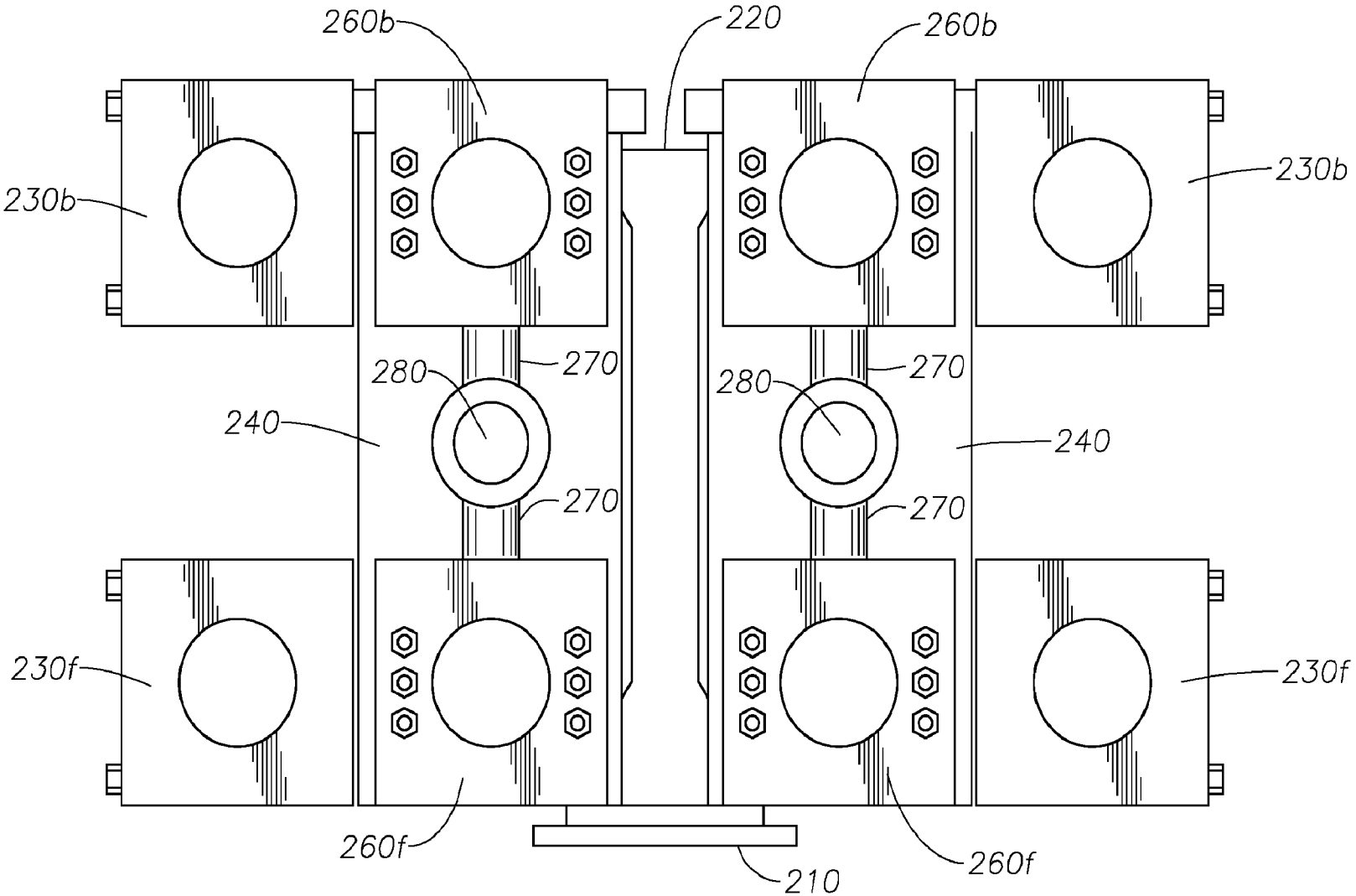

FIGS. 2A-B illustrate a fluid end 200 of a duplex mud pump in connection with various technologies described herein. FIG. 2A illustrates a side view of a fluid end 200, while FIG. 2B illustrates a top view of the fluid end 200. As previously mentioned above, a fluid end 200 refers to that part of the pump apparatus that moves fluid from a pump inlet to a pump discharge. The fluid end 200 may include a fluid inlet 210 which allows fluid from the fluid/mud tank to enter a suction manifold 220. The suction manifold 220 carries the fluid to four suction valve blocks 230. Two suction valve blocks 230 may be side mounted on each of two liner blocks 240. The suction valve blocks 230 may operate to control the fluid flow into the two liner blocks 240. One reciprocating piston enters each of the two liner blocks 240 at the piston inlets 250. The pistons (not shown) may operate to force the fluid out of the liner blocks 240 into four discharge valve blocks 260. Each liner block 240 has two discharge valve blocks 260 mounted thereon. The discharge valve blocks 260 may operate to allow the pressurized fluid to enter two discharge connectors 270 and exit out of discharge outlets 280.

The suction valve blocks 230 and the discharge valve blocks 260 may include flow passages. In one implementation, the flow passages may include check valves (not shown) for controlling the direction of flow of the fluid. Check valves may be disposed in the suction valve blocks 230 to only allow fluid to enter from the suction manifold 220. Check valves may also be disposed in the discharge valve blocks 260 to only allow fluid to exit into the discharge connectors 270.

In operation, on the forward stroke, the pump piston action draws fluid through the suction manifold 220 and front suction valve blocks 230*f* into the liner blocks 240, while the fluid already in the liner blocks 240 on the other side of the pistons is discharged through the back discharge valve blocks 260*b*. On the backward stroke, the pump piston action draws fluid through the suction manifold 220 and back suction valve blocks 230*b* into the liner blocks 240, while the fluid already in the liner blocks 240 on the other side of the pistons is discharged through the front discharge valve blocks 260*f*. Fluid in the liner block 240 is thus compressed and pressurized. In this manner, the pump is double acting in that fluid is discharged on both the forward and backward strokes of the piston. While the fluid end operation is described as having both pistons reciprocating in unison, it should be understood that the two pistons could be reciprocating in opposite directions such that while one strokes forward, the other strokes backward.

Figure 3:
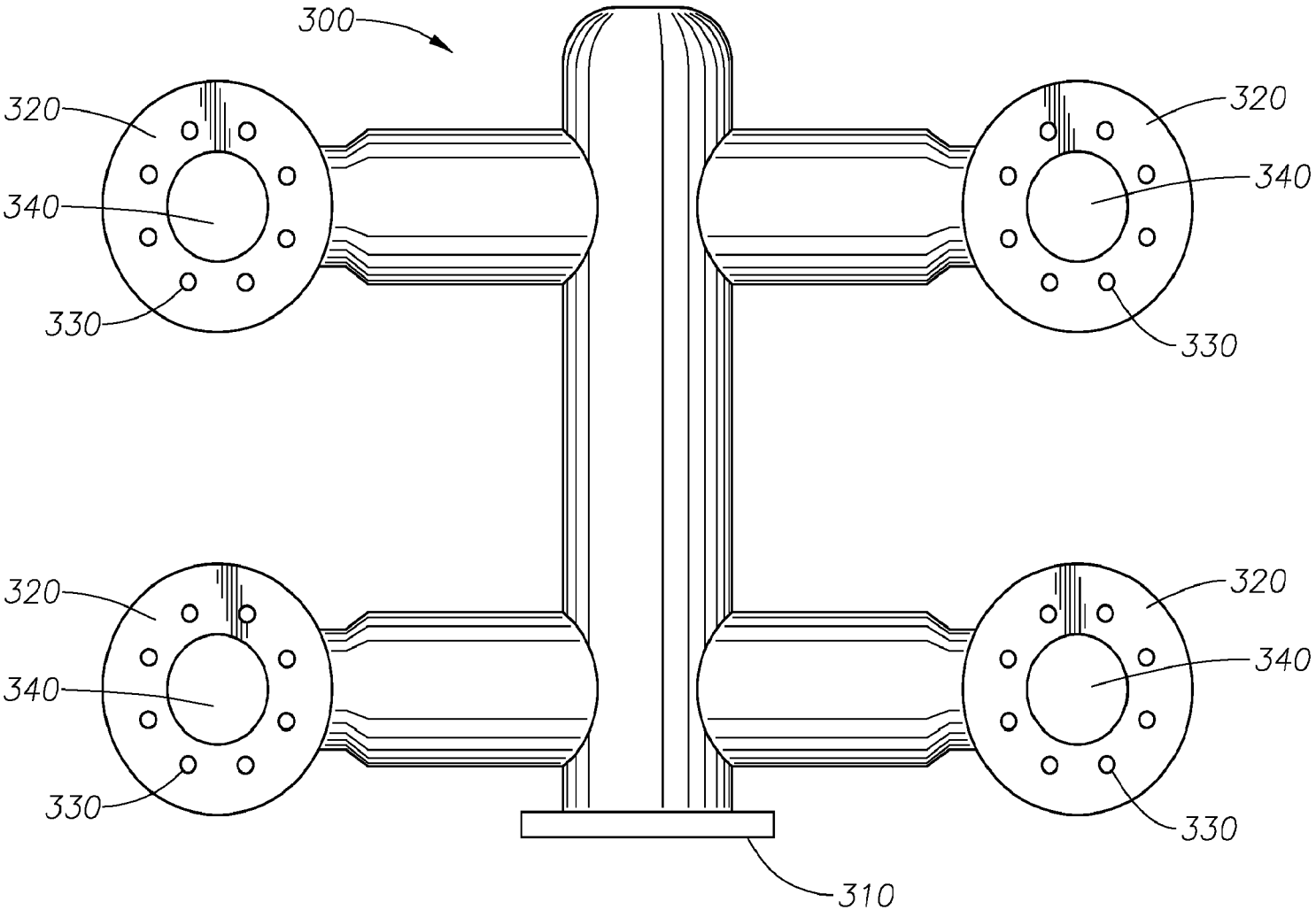
FIG. 3 illustrates a top view of a suction manifold in accordance with implementations of various technologies described herein.

FIG. 3 illustrates a top view of a suction manifold 300 in accordance with implementations of the various technologies described herein. The suction manifold 300 may be connected via a pump suction line (not shown) to a fluid/mud tank (not shown). The pump suction line (not shown) may be connected to the suction manifold 300 at the fluid inlet 310. The suction manifold 300 may also be coupled to four suction valve blocks 230. The suction manifold 300 may have four flanges 320, each may be configured to connect to the bottom of a suction valve block 230 by two or more cap screws and lock washers 330. Each cap screw and lock washer 330 may be bolted from the manifold side of the flange 320 into the suction valve block 230 once the suction manifold flange opening 340 is aligned with the suction valve block fluid inlet.

FIGS. 4A-B illustrate a suction valve block 400 in accordance with implementations of various technologies described herein. FIG. 4A illustrates a cross-sectional view of the suction valve block 400, which may include a fluid inlet 410, fluid passage 470 and fluid outlet 420. Fluid may enter the suction valve block 400 via the fluid inlet 410 from the suction manifold 300. The fluid may flow through the fluid passage 470 and exit the suction valve block 400 via the fluid outlet 420 into the liner block 240.

As described above, the bottom portion of the suction valve block 400 may be coupled to the suction manifold 300 by aligning the suction manifold flange opening 340 with the suction valve block fluid inlet 410 and securing the suction valve block 400 to the suction manifold 300 using two or more cap screws (not shown) from the underside of the suction manifold flange 320. As such, holes 430 for receiving the cap screws may be disposed at the bottom portion of the suction valve block 400. An "O" ring configured to form a seal between the suction manifold flange 320 and the suction valve block 400 may be disposed in a channel 440 on the suction valve block 400.

One side of the suction valve block 400 may be connected to the side portion of either the right or left liner block 240 at either the front or back end of the liner block 240. Each suction valve block 400 may be configured such that it may be used at any suction valve block location, i.e., front or back end of either right or left liner block 240.

FIG. 4B illustrates a side view of a suction valve block 400 in accordance with implementations of the various technologies described herein. Six bolt holes 460 disposed through the suction valve block 400 may be configured to receive stud bolts from the liner block. In one implementation, the six bolt holes 460 may be disposed linearly on each side of the fluid passage 470 in the suction valve block 400. An "O" ring configured to form a seal between the liner block 240 and the suction valve block 400 may be disposed in a channel 450 on the suction valve block 400. The suction valve block 400 may be coupled to the liner block 240 by mounting the six stud bolts on the liner block 240, sliding the six bolt holes 460 on the six stud bolts and securing the suction valve block 400 to the liner block 240 using hexagonal nuts. In this manner, the suction valve block fluid outlet 420 may be aligned with the liner block fluid inlet (not shown).

Figure 5A:
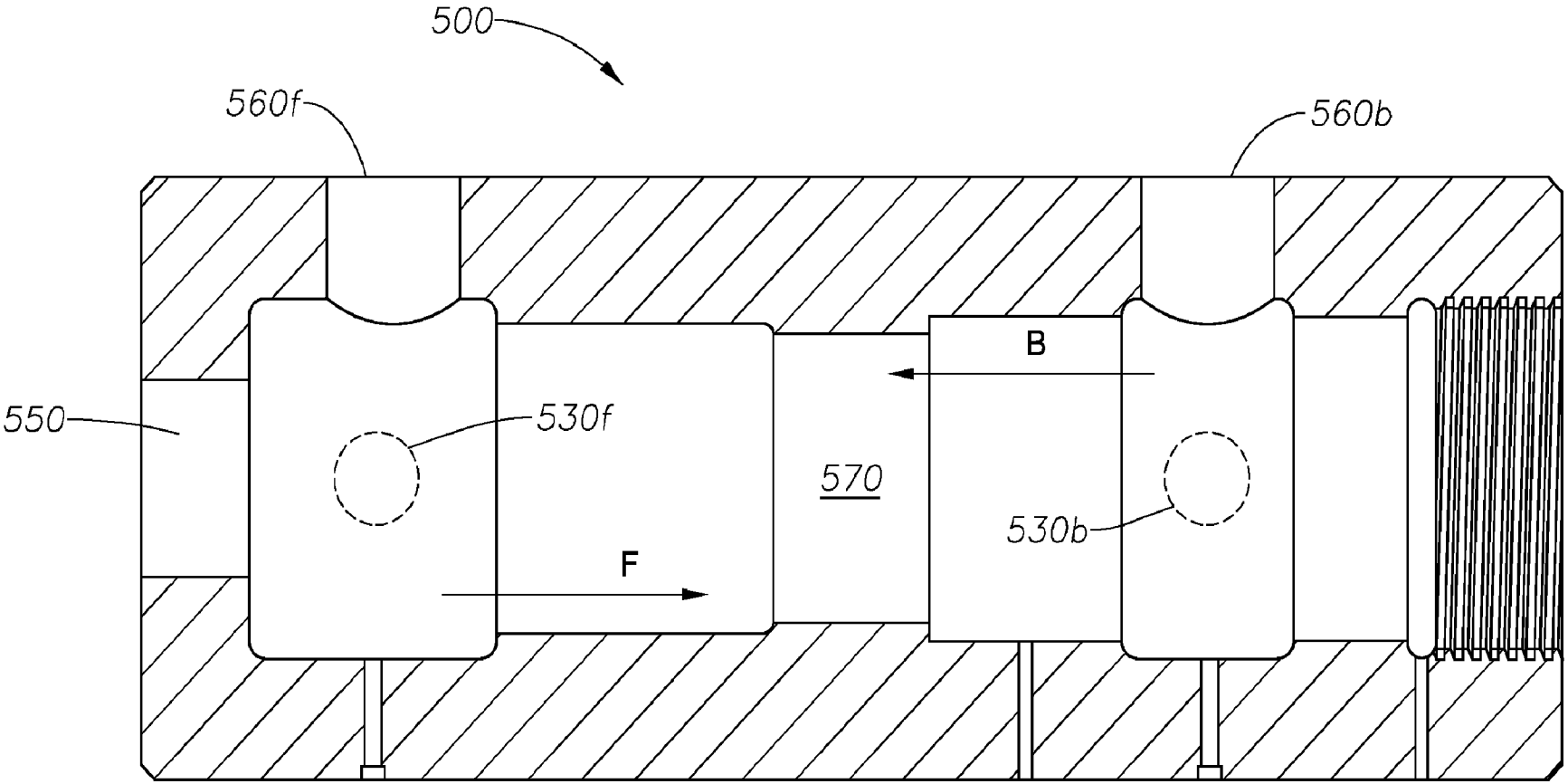

FIGS. 5A-D illustrate a liner block 500 in accordance with implementations of the various technologies described herein. FIG. 5A illustrates a cross-sectional view of the liner block 500. This illustration shows the liner block 500 without the reciprocating piston inside the fluid passage 570. The liner block 500 may have a piston inlet 550 in the front portion of the block 500. The liner block 500 may have one liner block inlet 530*f* and one liner block outlet 560*f* in the front portion of the block and one liner block inlet 530*b* and one liner block outlet 560*b* in the back portion of the block. The liner block inlet 530 may be configured to be aligned with the suction valve block fluid outlet 420 and the liner block outlet 560 may be configured to be aligned with the discharge valve block inlet, which will be described in more detail in the paragraphs below.

Figure 5B:
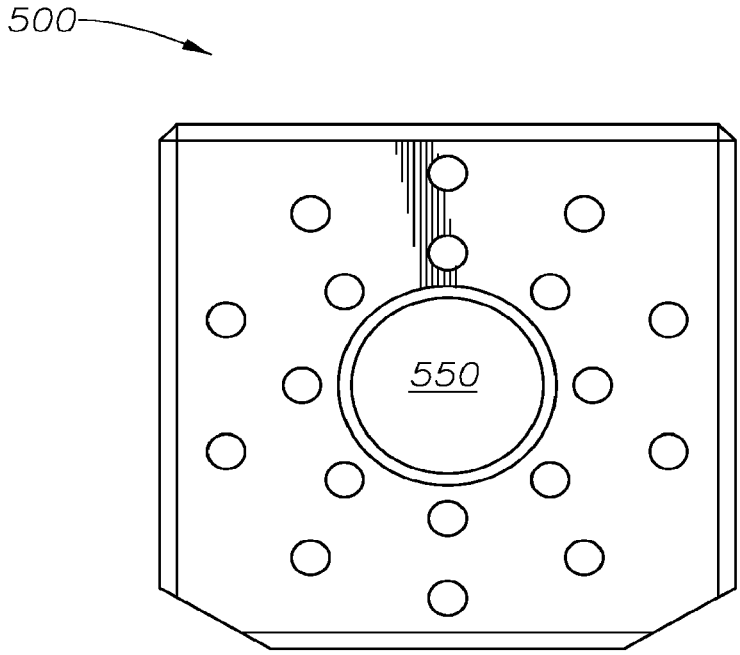

FIG. 5B illustrates a front view of the liner block 500 in accordance with implementations of the various technologies described herein. The liner block 500 may be connected to the power end 170 at this portion of the liner block 500. The piston inlet 550 opens into the fluid passage 570.

Figure 5C:
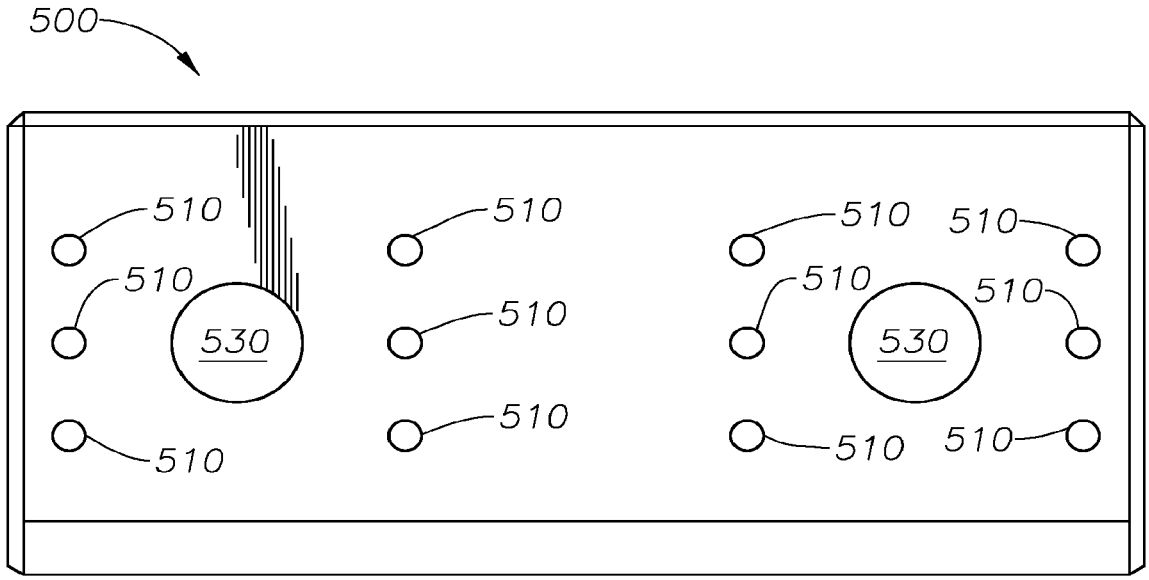

FIG. 5C illustrates a side view of a liner block 500 in accordance with implementations of the various technologies described herein. As discussed above, two suction valve blocks may be mounted on the side portion of the liner block 500 at the liner block inlets 530. An "O" ring disposed inside a channel on the suction valve block 400 may used to form a seal between the liner block 500 and the suction valve block 400. Six holes 510 for receiving stud bolts may be disposed through the liner block 500. As briefly mentioned above, the stud bolts may be used to couple the suction valve blocks 400 to the side portion of the liner block 500 and hexagonal nuts may be used on the stud bolts to secure the suction valve blocks 400 to the liner block 500.

FIG. 5D illustrates a top view of the liner block 500 in accordance with implementations of the various technologies described herein. Two discharge valve blocks may be mounted on top of the liner block 500 at the liner block outlets 560. Six holes 520 for receiving stud bolts may be disposed through the liner block 500. In one implementation, holes 510 are perpendicular to holes 520 and do not intersect with holes 520. The stud bolts may be used to couple the discharge valve blocks 260 to the top portion of the liner block 500. In one implementation, hexagonal nuts may be used on the stud bolts to secure the discharge valve blocks 260 to the liner block 500.

Figure 6B:
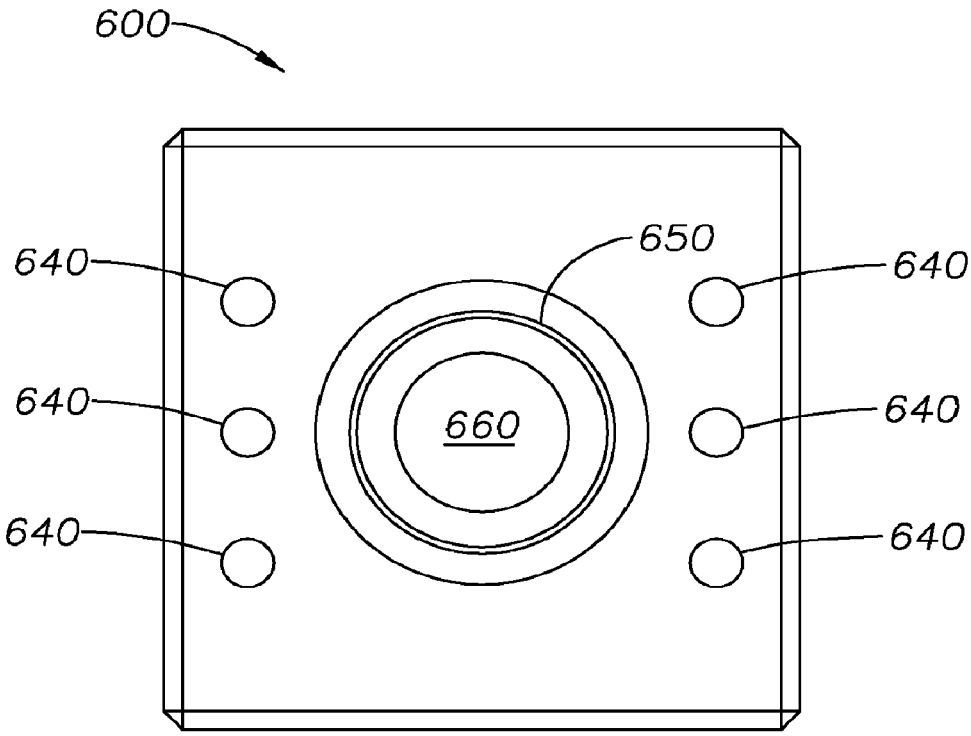
Figure 6C:
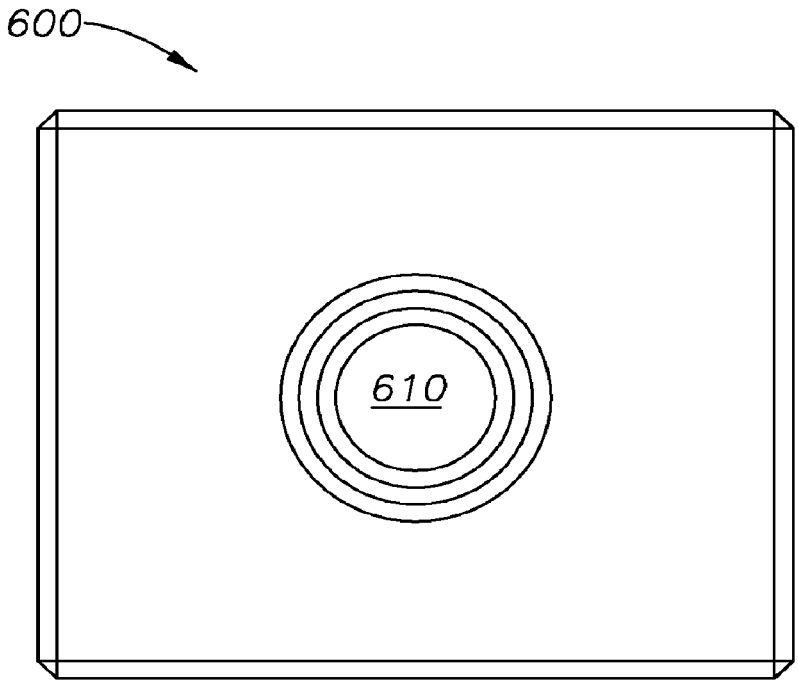

FIGS. 6A-C illustrate a discharge valve block 600 in accordance with implementations of the various technologies described herein. FIG. 6A illustrates a cross-sectional view of the discharge valve block 600. The discharge valve block 600 may include a fluid inlet 660, fluid passage 670 and fluid outlet 610. Fluid may enter the discharge valve block 600 via the fluid inlet 660 from the liner block. The fluid may flow through the fluid passage 670 and exit the discharge valve block 600 via the fluid outlet 610 into the discharge connector. In one implementation, the discharge valve block 600 may include two fluid outlets 610 and 620 so that the discharge valve block 600 may be configured to discharge fluid at either fluid outlet. For instance, if fluid is to be discharged through fluid outlet 610, then the fluid outlet 620 is plugged with a stopper or cover. On the other hand, if fluid is to be discharged through fluid outlet 620, then fluid outlet 610 is plugged with a stopper or cover. In this manner, the two fluid outlets provide versatility for discharging fluid through the discharge valve block 600.

FIG. 6B illustrates a bottom view of the discharge valve block 600 in accordance with implementations of various technologies described herein. The bottom of each discharge valve block 600 may be connected to the top of either the right or left liner block 500 at either the front or back end of the liner block 500. Each discharge valve block 600 may be configured such that it may be used at any discharge valve block location, i.e., front or back end of either right or left liner block 500. As discussed above, the discharge valve block fluid inlet 660 may be configured to be aligned with the liner block fluid outlet 560. An "O" ring configured to form a seal between the discharge valve block 600 and the liner block 500 may be disposed in a channel 650 on the discharge valve block 600. Six bolt holes 640 disposed through the discharge valve block 600 may be configured to receive stud bolts. In one implementation, the six bolt holes 640 may be disposed linearly on each side of the fluid passage 670 in the discharge valve block 600. To connect the discharge valve block 600 to the liner block 500, the discharge valve block 600 may be slid on the six stud bolts already mounted on the liner block 500 and secured by using hexagonal nuts on the stud bolts.

FIG. 6C illustrates a side view of the discharge valve block 600 in accordance with implementations of various technologies described herein. This side portion of the discharge valve block 600 may be coupled to a discharge connector 270, which is described in more detail in the paragraphs below.

Figure 7:
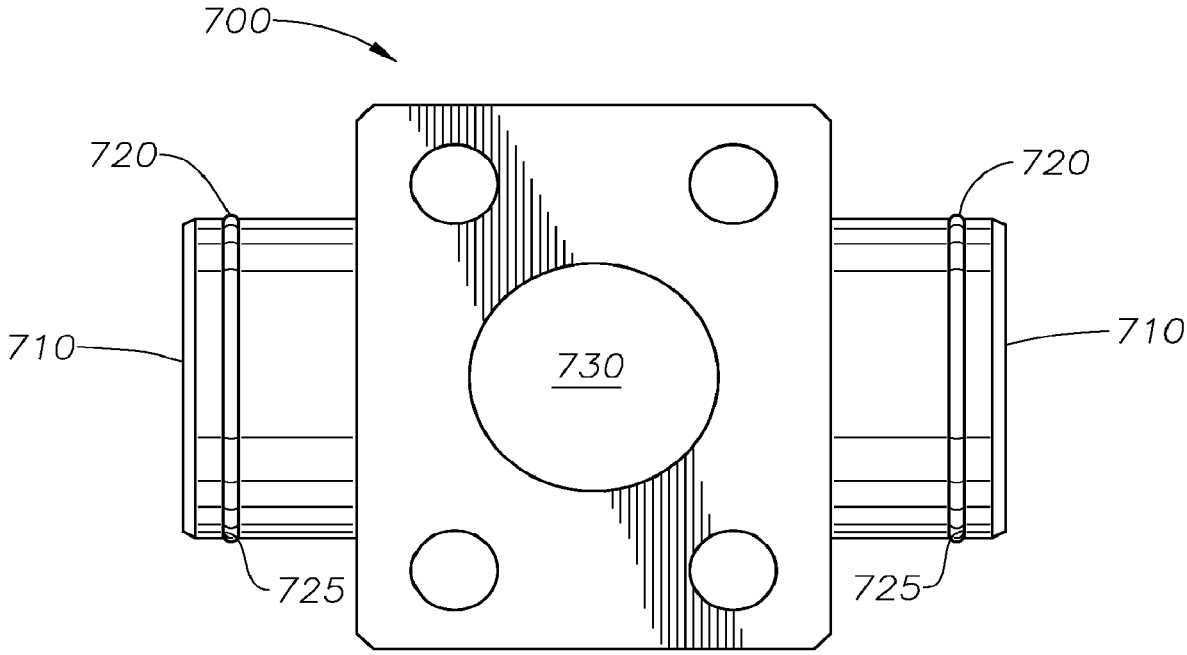
FIG. 7 illustrates a top view of a discharge connector in accordance with implementations of various technologies described herein.

FIG. 7 illustrates a top view of a discharge connector 700 in accordance with implementations of various technologies described herein. The discharge connector 700 may be configured to connect a discharge valve block disposed on the front end of a liner block 500 with a discharge valve block on the back end of the liner block 500. As such, the discharge connector 700 may be positioned parallel to the liner block 500. Although the discharge connector 700 is described as being positioned in parallel to the liner block, it should be understood that in some implementations, the discharge connector 700 may be positioned in perpendicular to the liner block. Each end 710 of the discharge connector 700 may have an "O" ring 720 configured to form a seal between the discharge connector 700 and the discharge valve block 600. Each "O" ring 720 may be disposed in a channel 725 on the discharge connector 700.

The discharge connector 700 may include a fluid inlet at each end 710. Each end 710 of the discharge connector 700 may be inserted between two discharge valve block fluid outlets 610. The discharge connector 700 may further include an outlet 730 at the top of the discharge connector 700. The outlet 730 may be coupled to a cross, discharge strainer, pulsation damper, pressure relief valve and the like. Thus, fluid flows from the fluid inlets at each end 710 of the discharge connector 700 through a fluid passage to the central fluid outlet 730.

Figure 8:
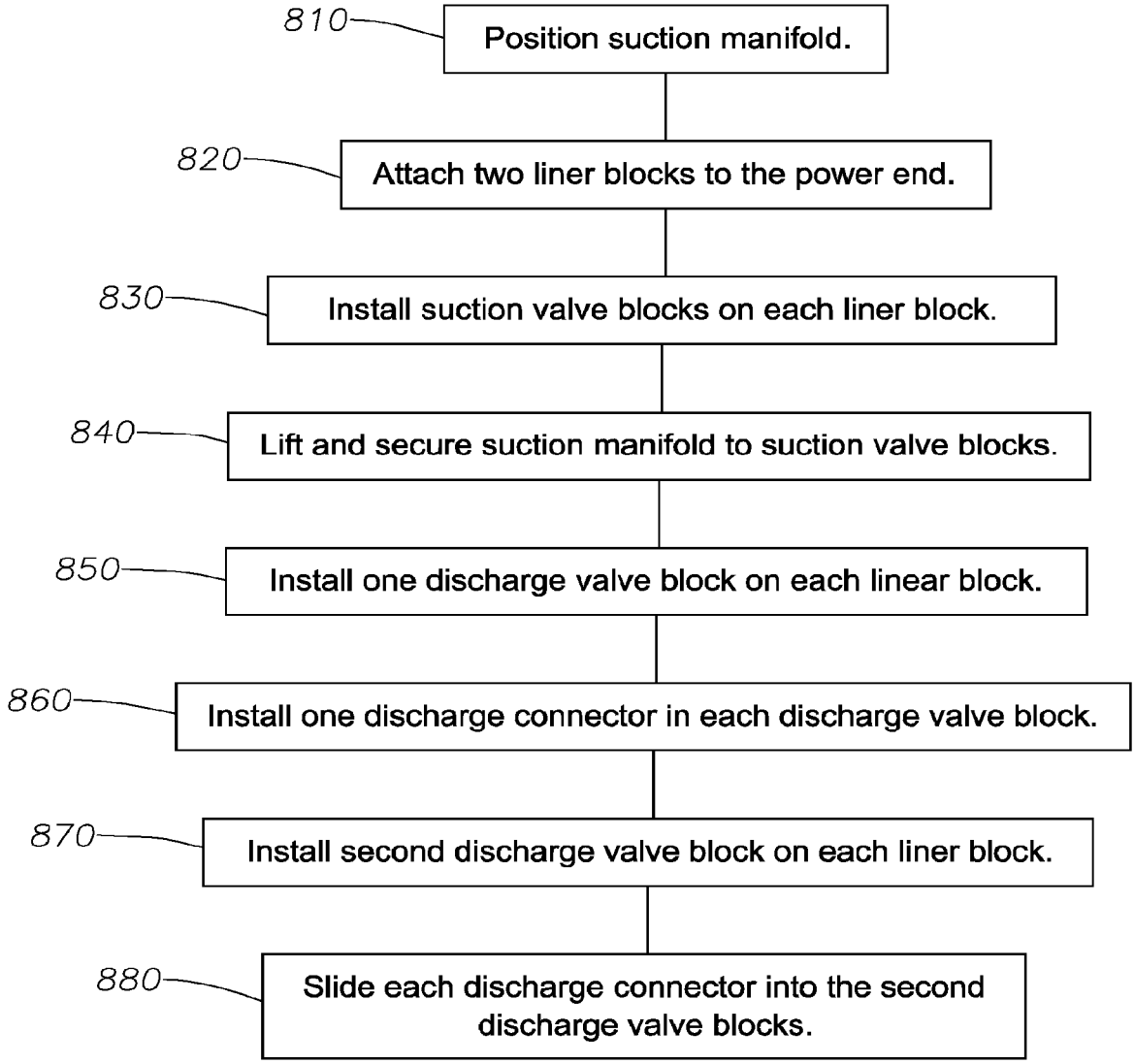
FIG. 8 illustrates a flow diagram of a method for assembling a modular fluid end in accordance with implementations of various technologies described herein.

FIG. 8 illustrates a flow diagram 800 of a method for assembling a modular fluid end in accordance with implementations of various technologies described herein. It should be understood that while the operational flow diagram 800 indicates a particular order of execution of the operations, in some implementations, the operations might be executed in a different order. At step 810, the suction manifold 300 may be positioned forward of the power end 170 on a moveable device such as a skid. At step 820, the two liner blocks 500 may be attached to the power end 170, such as using stud bolts and nuts or any other attachment mechanisms known in the art.

At step 830, the suction valve blocks 400 may be coupled to the side portion of each liner block 500. In one implementation, six stud bolts may be installed on the liner block 500 at each suction valve block location. The suction valve blocks 400 may then be slid into position over the stud bolts and secured with hexagonal nuts. At step 840, the suction manifold 300 may be lifted into position and secured to the four suction valve blocks 400 using cap screws and lock washers.

At step 850, two discharge valve blocks 600 may be installed on one end of the liner blocks 500, i.e., either the front end or the back end. In other implementations, one discharge valve block 600 may be installed on one end while the other is installed at the opposite end. In one implementation, six stud bolts may be installed on the liner block 500 at each discharge valve block location. Each discharge valve block 600 may then be aligned such that its fluid outlet 610 faces the fluid outlet 610 of the other discharge valve block on the same liner block. Finally, the discharge valve blocks 600 may be slid into position over the stud bolts and secured with hexagonal nuts.

At step 860, a discharge connector 700 may be inserted into each installed discharge valve block fluid outlet 610. In one implementation, one end 710 of the discharge connector 700 may be inserted into the discharge valve block fluid outlet 610 and slid in as far as possible.

At step 870, the remaining two discharge valve blocks 600 may be installed in the same manner that the other two discharge valve blocks 600 were installed.

At step 880, the discharge connectors 700 that have been inserted into the installed discharge valve block fluid outlets 610 at step 860 may now be inserted into the fluid outlets 610 of the discharge valve blocks 600 recently installed at step 870. In one implementation, the discharge connector 700 may be slid into the fluid outlets 610 of the newly installed discharge valve blocks 600. The discharge connectors 700 may then be centered and rotated such that the discharge connector outlet 730 is approximately equidistant between the discharge valve blocks and faces up.

Various technologies described herein have many advantages. For example, a fluid end that is assembled from forged steel modules that are bolted together may enable field replacement of any component without the use of a welder and portable boring system. Worn or washed out modules may be shop repaired while the pump continues operation with replacement modules. In this manner, modular fluid end components as described herein may reduce cost by reducing downtime, transportation costs, and the like. In addition, modular fluid end components may require less energy, time and cost to manufacture.

Although various implementations discussed herein are with reference to mud pumps, it should be understood that some implementations may be applicable in other types of pumps, such as other fluid pumps and the like. Although various implementations are described using stud bolts and hexagonal nuts or cap screws, it should be understood that in some implementations, other types of fasteners (e.g., various types of screws, pins and bolts) may be used.

While the foregoing is directed to implementations of various technologies described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for assembling a fluid end for a duplex pump, comprising:

coupling a first set of suction valve blocks to a side portion of a first liner block;

coupling a second set of suction valve blocks to a side portion of a second liner block;

coupling the first and second sets of suction valve blocks to a suction manifold;

coupling a first discharge valve block to a first end of a top portion of the first liner block;

coupling a second discharge valve block to the first end of a top portion of the second liner block;

coupling a first discharge connector to the first discharge valve block;

coupling a second discharge connector to the second discharge valve block;

coupling a third discharge valve block to a second end of the top portion of the first liner block;

coupling a fourth discharge valve block to the second end of the top portion of the second liner block;

coupling the first discharge connector to the third discharge valve block; and coupling the second discharge connector to the fourth discharge valve block.

2. The method of claim 1, further comprising coupling the first and second liner blocks to a power end of the duplex pump.

3. The method of claim 1, wherein the first set of suction valve blocks are coupled to the side portion of the first liner block by installing stud bolts on the first liner block and sliding the first set of suction valve blocks on the stud bolts.

4. The method of claim 1, wherein the first discharge valve block is coupled to the top portion of the first end of the first liner block by installing stud bolts on the first end of the first liner block and sliding the first discharge valve block on the stud bolts.

5. The method of claim 1, wherein the first discharge connector is coupled to the first discharge valve block by inserting the first discharge connector into the first discharge valve block.

6. The method of claim 1, wherein the third discharge valve block is coupled to the second end of the first liner block by installing stud bolts on the second end of the first liner block and sliding the third discharge valve block on the stud bolts.

7. The method of claim 1, wherein the first discharge connector is coupled to the third discharge valve block by inserting the first discharge connector into the third discharge valve block.

8. The method of claim 7, wherein the first discharge connector is centered such that a discharge connector outlet on the first discharge connector is approximately equidistant between the first discharge valve block and the third discharge valve block.

9. The method of claim 7, further comprising rotating the first discharge connector such that a discharge connector outlet on the first discharge connector is pointed upward.

10. A method for assembling a fluid end for a duplex pump, comprising:

coupling two liner blocks to a power end of the duplex pump;

coupling a set of two suction valve blocks to a side portion of each liner block;

coupling both sets of suction valve blocks to a suction manifold;

coupling a first discharge valve block to a first end of a top portion of each liner block;

coupling a discharge connector to each first discharge valve block;

coupling a second discharge valve block to a second end of the top portion of each liner block; and coupling the discharge connector to each second discharge valve block.

11. The method of claim 10, wherein the suction valve blocks are coupled to the side portion of the liner blocks by installing stud bolts on each liner block and sliding the set of suction valve blocks on the stud bolts.

12. The method of claim 10, wherein the suction valve blocks are coupled to the suction manifold using cap screws.

13. The method of claim 10, wherein each first discharge valve block is coupled to the top portion of the first end of each liner block by installing stud bolts on the first end of each liner block and sliding each first discharge valve block on the stud bolts.

14. The method of claim 10, wherein each discharge connector is coupled to each first discharge valve block by inserting each discharge connector into each first discharge valve block.

15. The method of claim 10, wherein each second discharge valve block is coupled to the second end of each liner block by installing stud bolts on the second end of each liner block and sliding each second discharge valve block on the stud bolts.

16. The method of claim 10, wherein each discharge connector is coupled to each second discharge valve block by inserting each discharge connector into each second discharge valve block.

17. The method of claim 10, wherein each discharge connector is centered such that a discharge connector outlet on each discharge connector is approximately equidistant between the first discharge valve block and the second discharge valve block.

18. The method of claim 10, further comprising rotating each discharge connector such that a discharge connector outlet on each discharge connector is pointed upward.

19. A method for assembling a fluid end for a duplex pump, comprising:

coupling two liner blocks to a power end of the duplex pump;

installing stud bolts on each liner block;

coupling a set of two suction valve blocks to a side portion of each liner block by sliding the two suction valve blocks over the stud bolts and securing the two suction valve blocks to each liner block using hexagonal nuts;

coupling both sets of suction valve blocks to a suction manifold;

coupling a first set of two discharge valve blocks to a first end of a top portion of each liner block;

coupling a second set of two discharge valve blocks to a second end of the top portion of each liner block;

coupling a first discharge connector between one of the first set of discharge valve blocks and one of the second set of discharge valve blocks; and coupling a second discharge connector between the other one of the first set of discharge valve blocks and the other one of the second set of discharge valve blocks.

20. The method of claim 19, further comprising aligning the first set of discharge valve blocks with the second set of discharge valve blocks such that the fluid outlets of the first set of discharge valve blocks face the fluid outlets of the second set of discharge valve blocks.

* * * * *